US006123061A

United States Patent [19]

Baker et al.

[11] Patent Number: 6,123,061

[45] Date of Patent: Sep. 26, 2000

[54] CRANKCASE VENTILATION SYSTEM

[75] Inventors: Glenn L. Baker; David M. Ruch; John M. Partridge; Brett Herrick, all of Columbus, Ind.

[73] Assignee: Cummins Engine Company, Inc., Columbus, Ind.

[21] Appl. No.: 08/805,935

[22] Filed: Feb. 25, 1997

[51] Int. Cl.[7] ..... F02M 25/06

[52] U.S. Cl. ..... 123/573

[58] Field of Search ..... 123/572, 573, 123/574

[56] References Cited

U.S. PATENT DOCUMENTS

| | | | |
|---|---|---|---|
| 3,411,706 | 11/1968 | Woollenweber et al. . | |
| 3,978,671 | 9/1976 | Gonzalez . | |
| 4,169,432 | 10/1979 | White . | |
| 4,329,966 | 5/1982 | Ramsley . | |
| 4,557,226 | 12/1985 | Mayer et al. . | |
| 4,901,703 | 2/1990 | Humphries . | |
| 4,920,930 | 5/1990 | Sakano et al. . | |
| 4,958,613 | 9/1990 | Hiraoka et al. . | |
| 4,962,745 | 10/1990 | Ohno et al. | 123/573 |
| 5,080,082 | 1/1992 | Mueller et al. . | |
| 5,115,791 | 5/1992 | Dore . | |
| 5,140,957 | 8/1992 | Walker . | |
| 5,429,101 | 7/1995 | Uebelhoer et al. | 123/572 |
| 5,450,835 | 9/1995 | Wagner . | |
| 5,456,239 | 10/1995 | Henderson et al. . | |
| 5,479,907 | 1/1996 | Walker, Jr. . | |
| 5,499,604 | 3/1996 | Ito et sal. | 123/41.86 |
| 5,499,616 | 3/1996 | Enright . | |
| 5,564,401 | 10/1996 | Dickson . | |
| 5,669,366 | 9/1997 | Beach et al. | 123/572 |

FOREIGN PATENT DOCUMENTS

| | | | |
|---|---|---|---|
| 25 32 131 A1 | 3/1977 | Germany . | |
| 3504090 A1 | 2/1987 | Germany . | |
| 297 09 320 U 1 | 7/1997 | Germany . | |
| 155520 | 9/1984 | Japan | 123/572 |

*Primary Examiner*—Marguerite McMahon
*Attorney, Agent, or Firm*—Nixon Peabody LLP; Charles M. Leedom, Jr.; Donald R. Studebaker

[57] ABSTRACT

A closed crankcase ventilation system for a turbocharger internal combustion engine which uses differential pressure between the turbo compressor inlet and the crankcase to force blow-by gases through a separation device. The zone of low pressure of the turbo compressor inlet is located at the innermost diameter of the compressor inlet shroud. The difference between the pressure in the compressor inlet and the crankcase creates a vacuum which pulls gas from the crankcase into the ventilation system. The ventilation system includes a high restriction separator for removing oil from the blow-by gases. A control valve bypasses the separation device when insufficient pressure differential exists to drive the separator. Additionally, a system for ventilating crankcase gases from a crankcase of the engine includes a first flow passage communicating between the crankcase and a turbocharger of the engine, an high restriction separator positioned in the flow passage for separating air contaminant mixtures from crankcase gases, a first connection for connecting a first end of the flow passage to the crankcase, a second connection for connecting a second end of the flow passage to a predetermined point of the turbocharger, a second flow passage communicating between the first flow passage and an intake manifold of the engine, and a bypass flow passage for bypassing the separator. In this case, the crankcase gases are directed through the separator during heavy load, light load and idle operating conditions when sufficient vacuum exists to draw the crankcase gases through the coalescing filter and through the bypass flow passage when a sufficient vacuum is not present.

21 Claims, 4 Drawing Sheets

FIG. 1
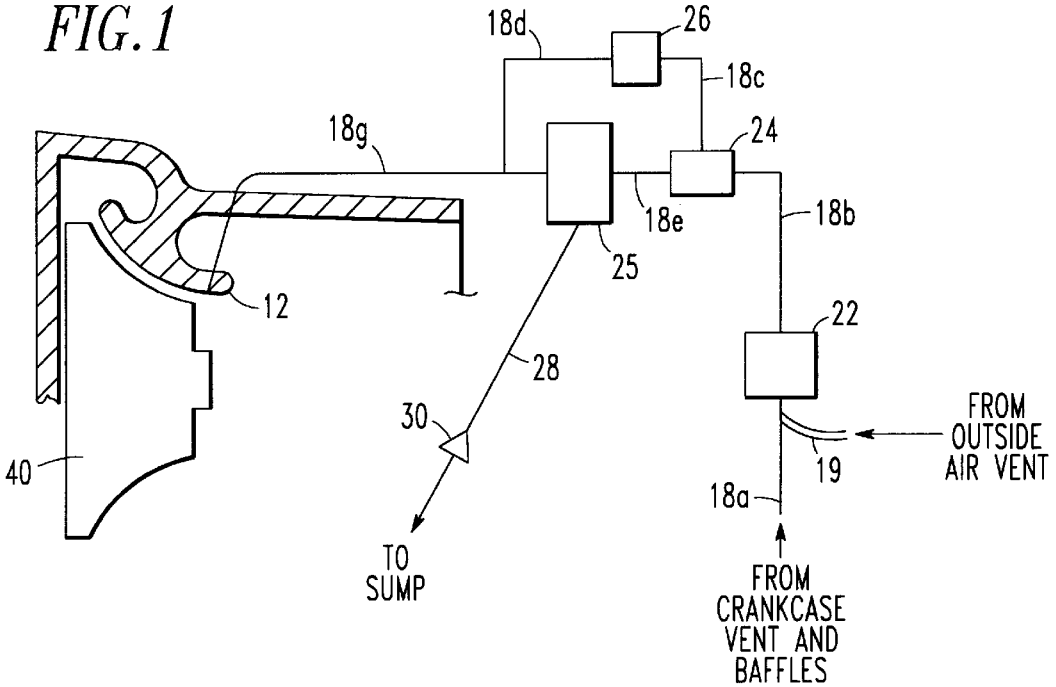
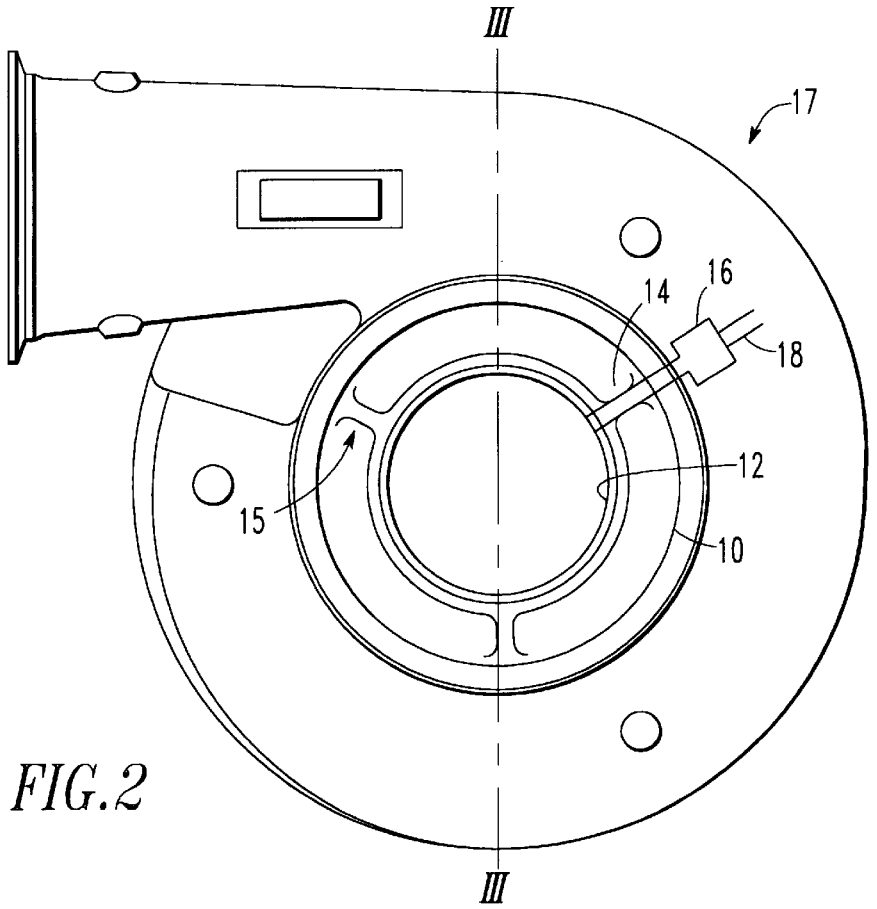
FIG. 2

CRANKCASE VENTILATION SYSTEM

TECHNICAL FIELD

This invention relates in general to improvements in a turbocharger internal combustion engine, and more particularly, to improvements in regulating blow-by gases in a closed crankcase ventilation system.

BACKGROUND OF THE INVENTION

The EPA and CARB regulate internal combustion engine emissions. Initially, the majority of these regulations were focused on stack emissions. But increasingly stringent environmental regulations and a heightened consciousness of environmental conservation have also mandated cleaner operation of hydrocarbon powered sources such as automobiles, boats, trucks, motorcycles and the like. It is anticipated that new federal and CARB emissions regulations will require these discharged gases to be cleaned and will include crankcase gases as part of the regulated diesel engine emissions.

Combustion gas is blown out from an engine combustion chamber into a crankcase through a clearance between a piston and a cylinder resulting in blow-by gas. During the operation of the engine, small amounts of hot combustion gases leak past the piston rings and through the oil circulating within the crankcase to create a pressurized mixture of air, exhaust gases and atomized oil. At small throttle openings or low loads, for diesel engines, the amount of blow-by gas is not troublesome but at large throttle openings the amount of blow-by gas is such that considerable pressures can develop in the crankcase. If left unvented, this pressure may lead to the penetration of oil seals between the crankshaft and the engine block resulting in an undesirable loss of engine oil and pollution in the form of constant oil leakage from the vehicle. Sufficient venting of such gas is, therefore, required. In some internal combustion engines, baffles are provided in front of the vent openings for removing some of the oil in the blow-by gases. The remaining harmful emissions are vented into the air via a road draft tube or, through a PCV valve, are returned to the induction line of the internal combustion engine upstream of the air filter or passed into an air-oil separator. While venting through a road draft tube reduces the pressure in the crankcase, oil is still allowed to escape from the engine into the outside environment.

As a result, blow-by devices such as pollution control valves have become required standard equipment for all automobiles. These blow-by devices capture emissions from the crankcase of a hydrocarbon burning engine and, in a closed system, communicate them to the air intake device for combustion. The emissions generated from the crankcase of diesel engines are heavily laden with oil and contain other heavy hydrocarbons. Accordingly, air-oil separators have been developed in an effort to make the operation of such engines cleaner and more efficient. An air-oil separator contains a filter and may be either integrated in the valve cover or inserted as an individual component. The density of the filter used is determined by the pressure difference between the crankcase and the compressor inlet or the atmosphere for an open system. A partial vacuum is created at the compressor inlet. The greater the available partial vacuum, the denser the filter may be and the "cleaner" the emission gas. The air-oil separators filter out a large proportion of the oil contained in the blow-by gas before the gas passes into the open or is returned to the engine. Such devices also function to filter air in an air inlet flow line to an engine, separate oil and other hydrocarbons emitted from a contaminated engine atmosphere, and regulate the pressure within the engine crankcase.

When the air-oil separators presently available on the market are used, a considerable quantity of oil still breaks through. None of these separators, therefore, has provided an entirely satisfactory solution to the aforementioned problems. U.S. Pat. Nos. 5,140,957 to Walker and 5,479,907 to Walker, Jr. disclose crankcase ventilation systems which use the differential pressure between the crankcase and the turbocharger inlet to force air through a separation device. These systems, however, use conventional automotive filters such as polyester fiber filters which are not 100 percent effective. The systems also fail to disclose a bypass and control valve to handle the different pressure levels in the crankcase. A crankcase ventilation system with a bypass valve and a control valve is shown in U.S. Pat. No. 4,329,966 to Ramsley. However, the bypass is only operated when the vacuum increases beyond a predetermined level.

The air filters used in the air-oil separators of the prior art are generally composed of wire mesh, steel wool or foam. These filters are generally less than 70 percent effective and are driven by pressure in the crankcase. Traditionally, the air-oil separator device is connected by a flow line to the inlet duct of the turbocharger.

The increasing governmental regulation and environmental awareness requires careful treatment of emissions from hydrocarbon burning engines. A need exists, therefore, to provide an improved apparatus for separating contaminants from the crankcase emissions of hydrocarbon powered engines in an efficient manner, minimizing the extent of contaminants released into the environment and improving the operation of the engine. This invention uses the reduced pressure generated within the turbocharger itself to drive a high efficiency filter or separation device. The cleaned gas can then pass through the compressor and aftercooler without fouling the flow passages.

SUMMARY OF THE INVENTION

It is a primary object of the present invention, therefore, to overcome the deficiencies of the prior art and to provide a crankcase ventilation system for a turbocharger internal combustion engine which includes utilizing the very low pressure located along the compressor inlet to drive a coalescing filter.

It is another object of the present invention to provide a crankcase ventilation system for a turbocharger internal combustion engine which eliminates the contaminants in blow-by gases.

It is still another object of the present invention to provide a practical and economical ventilation system that is capable of separating substantially all of the oil droplets entrained in the gases expelled from an engine crankcase, and effectively recirculating the separated oil back to the oil supply of the engine.

It is yet a further object of the present invention to provide a crankcase ventilation system that can be adapted to a variety of turbocharger internal combustion engines.

The present invention provides a closed crankcase ventilation system for a turbocharger internal combustion engine. The crankcase ventilation system uses differential pressure between the turbo compressor inlet and the crankcase to force blow-by gases through a separation device comprised of a coalescing filter, an impactor or a similar device. The zone of extremely low pressure which drives the system is located along the shroud of the turbocharger compressor wheel. The difference between pressure in the compressor inlet and the crankcase creates a partial vacuum which pulls gas from the crankcase into the ventilation system. A vacuum limiting device limits the maximum crankcase vacuum. A bypass and control valve bypasses the separation device when engine air flow is too low to generate adequate pressure differential to drive the high efficiency filter. A secondary wire mesh filter provides blowby gas filtration when the bypass is operating.

More specifically, a system for ventilating crankcase gases from a crankcase of an internal combustion engine is provided including a flow passage conmmunicating between the crankcase and a turbocharger of the engine, an air flow driven air contaminant mixture separation means positioned in the flow passage for separating air contaminant mixtures from crankcase gases, a first connection means for connecting a first end of said flow passage to the crankcase and a second connection means for connecting a second end of the flow passage to a predetermined point at the turbocharger with the predetermined point of the turbocharger being a point where a vacuum sufficient to drive the air flow driven air contaminant mixtures separation means. Additionally, a bypass passage may be provided to bypass the separation means during certain operating conditions.

In addition to the foregoing, the present invention includes a system for ventilating crankcase gases from a crankcase of the engine including a first flow passage communicating between the crankcase and a turbocharger of the engine, an air flow driven contaminant mixture separator positioned in the flow passage for separating air contaminant mixtures from crankcase gases, a first connection for connecting a first end of the flow passage to the crankcase, a second connection for connecting a second end of the flow passage to a predetermined point of the turbocharger, a second flow passage communicating between the first flow passage and an intake manifold of the engine, and a bypass flow passage for bypassing the separator. In this case, the crankcase gases are directed through the separator during heavy load, light load and idle operating conditions and through the bypass flow passage during light-medium load conditions.

These and further objects, features and advantages of the present invention will become apparent from the following description when taken in connection with the accompanying drawings and appended claims.

BRIEF DESCRIPTION OF THE DRAWINGS

FIG. 1 shows a side elevation schematic of the crankcase ventilation system for a turbocharger internal combustion engine of the present invention;

FIG. 2 shows a front view of the compressor cover of a turbocharger internal combustion engine of the present invention.

DETAILED DESCRIPTION OF THE INVENTION

The present invention is designed to overcome the disadvantages of known crankcase ventilation systems for turbocharger internal combustion engines and to provide a system which will substantially reduce blow-by gas contaminants by utilizing a coalescing filter or other high efficiency separator. The coalescing filter is driven by a zone of extremely low pressure at the compressor inlet. This system effectively assures use of an extremely dense filter and minimizes contaminants in the blow-by gas.

Figure 3:
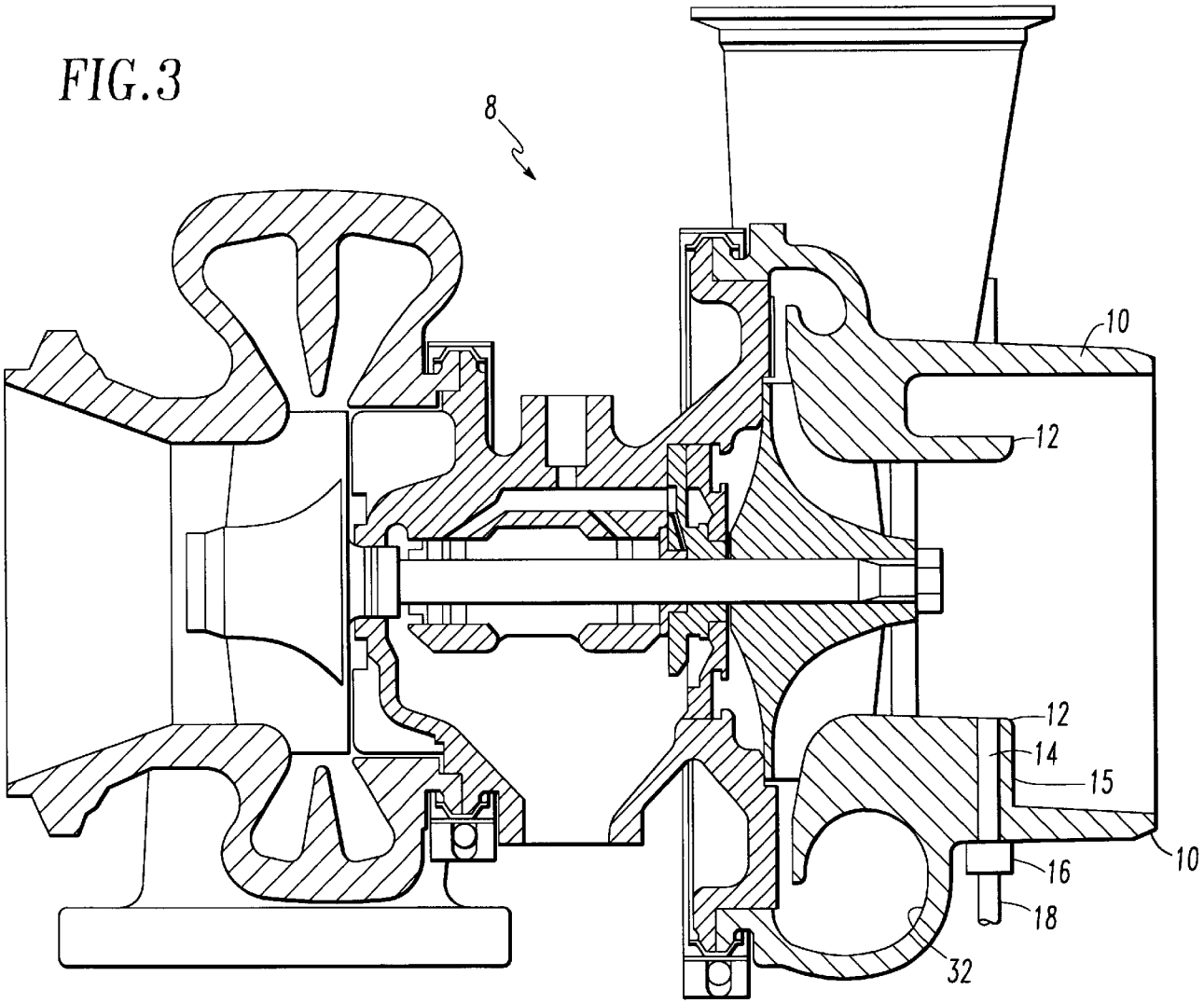
FIG. 3 is a cross-sectional view of the compressor cover of FIG. 2 taken along the line III—III of FIG. 2.

Turbocharger systems are used with internal combustion engines to supply pressurized intake air to the cylinders for improving combustion which decreases undesirable emissions and increases performance and efficiency. With connections formed as shown in FIGS. 1–3, the intake air turbocharger 8 creates a vacuum for pulling air into the ventilation system. The vacuum is caused by the very high airflow velocities at the compressor inlet. The degree of pressure reduction varies according to the location of the flow path connection point along the shroud of the compressor wheel.

Figure 4:
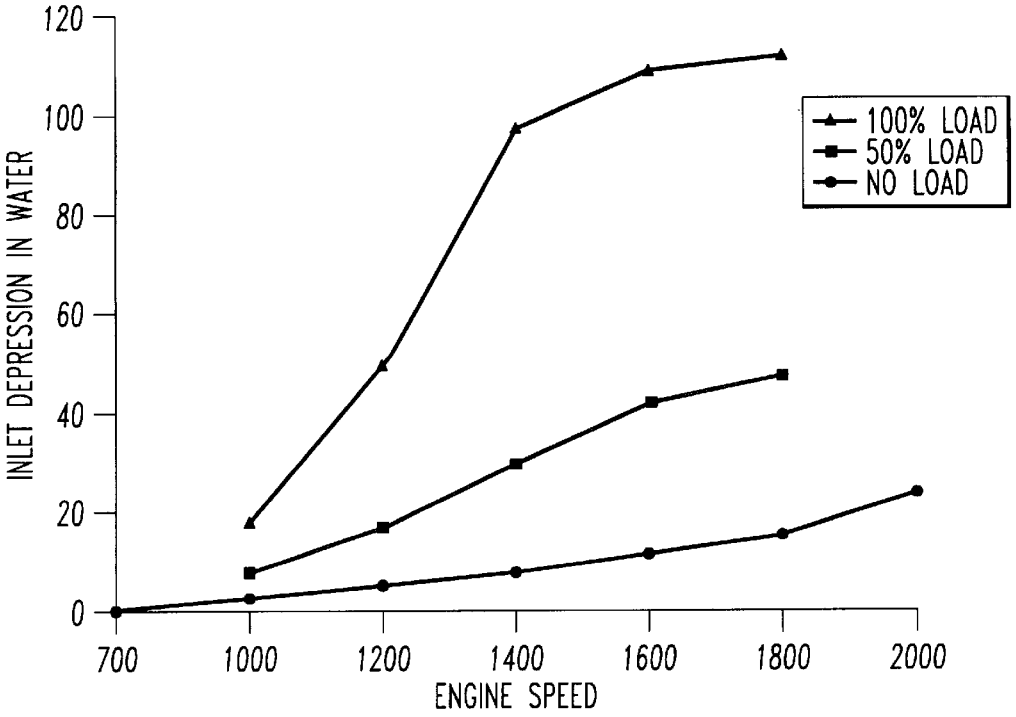
FIG. 4 graphs the extent of inlet depression of a compressor inlet shroud vacuum at various engine speeds in a Cummins' 94 N14 HT60 turbocharger internal combustion engine typical of engines to which the present invention may be adapted.

FIGS. 2 and 3 illustrate the location of negative pressure zones. Prior art utilizes a zone 10 at the largest diameter of the compressor inlet as the zone of low pressure harnessed to pull air through an air-oil separator. This generally being the five inch diameter. The present invention, however, focuses on a compressor inlet zone 12 of much lower pressure located at the smallest or innermost diameter of the compressor inlet, preferably, the three inch diameter section. The vacuum formed from a flow line connection at compressor inlet zone 12 is extremely high and is graphed in FIG. 4. For example, the vacuum at the compressor inlet zone 12 ranges from one inch of water to 113 inches of water for a Cummins' 94N14 HT60 turbocharger mounted on an engine. These measurements were made in a test cell and vary depending on speed, load, intake restriction and the like. The pressure drop located at compressor inlet zone 12 creates a vacuum strong enough to drive a coalescing filter, which typically requires at least 20 inches of water to operate effectively.

To harness the low pressure source, a bore 14 is drilled through aluminum support webs 15 in the compressor cover 17 to the desired location. Again, preferably this location being the diameter width of three inches. A flow line fitting 16 is threaded into the outside of the bore 14. A flow line 18 to an air-oil separator may then be attached to the fitting 16. The zone 12 extends from the shroud-leading edge to the compress blade tips but it is preferred to place the flow line 18 as close as possible to the tip of the compressor blades (not shown) of the compressor wheel 40 as the blades reduce the available flow area causing the flow to accelerate.

Referring to FIG. 1, in the operation of the crankcase ventilation system, blow-by gas is pulled from the crankcase vent (not shown) and through the baffle plates (not shown). The oil in the contaminated air impacts and condenses or is absorbed on the interior surface of the outer wall and the exterior surface of the baffle plates. The gas is then emitted into flow line 18a and flows into the vacuum limiting valve 22.

The vacuum limiting valve 22 limits the maximum vacuum maintained in the crankcase, preferably to a range of plus or minus two inches of water. In the present preferred embodiment, if the vacuum developed in the flow line 18*a* increases beyond a predetermined vacuum level, such as lower than minus two inches of water, outside air is pulled in from an air tube 19 into the flow line 18*a*. This prevents the creation of an excessive crankcase vacuum that could damage the oil pan or create oil seal leaks.

From the vacuum limiting valve 22, the blow-by gas moves through flow line 18*b* into the bypass and control valve 24 and may then pass into a separation device 25. The separation device 25 is a high restriction separator such as a coalescing filter, an impactor or another similar device. A coalescing filter approaches 100 percent efficiency in filtering contaminants out of the gas. A high coalescing filter differential pressure of 20 inches of water or higher, drives the blow-by gas through the filter. Since the coalescing filter located at the separation device 25 does not operate at low pressure differential, an alternative means must be provided for filtration when the engine is at idle or operating at low engine power levels. In the instances of low vacuum operation, the bypass and control valve 24 will operate to direct the gas flow into flow line 18*c*. Flow line 18*c* directs the gas through a secondary filter 26. Secondary filter 26 may be a traditional wire mesh, steel wool, plastic foam or fiberglass filter. After gas passes through secondary filter 26, which requires only a small differential pressure to operate and has reduced efficiency levels, it returns to flow line 18*d* and passes into flow line 18*g* and into the compressor inlet at the compressor inlet zone 12.

If the vacuum maintained by the compressor inlet is at least approximately 20 inches of water vacuum, the gas passes through flow line 18*e* into separation device 25. At separation device 25, the gas passes through the coalescing filter. The very high efficiency of the filter allows the contaminants to build up in the separation device 25 and then drain through flow line 28. The coalesced oil in drain line 28 is passed through a check valve 30 and then returned to the sump (not shown). The check valve 30 assures that the contaminated mixture will flow in one direction toward the sump. After passing through the separation device 25, the decontaminated air enters the turbocharger compressor inlet.

Various changes and modifications to the preferred embodiment herein chosen for the purpose of illustration may occur to those skilled in the art. To the extent that such variations and modifications do not depart from the spirit and scope of the invention, they are intended to be included within the scope thereof.

Figure 5:
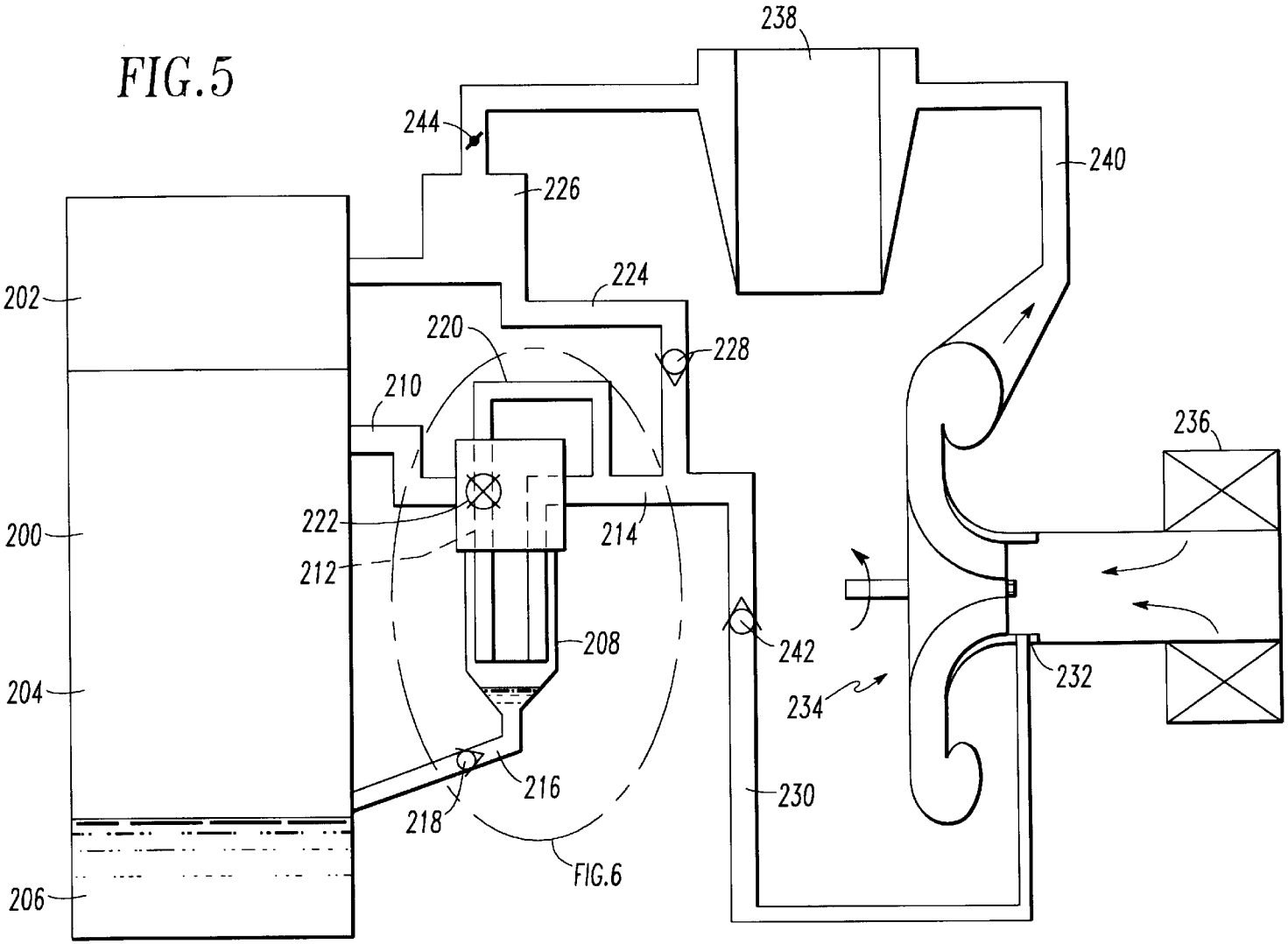
FIG. 5 is a schematic representation of a crankcase ventilation system for a turbocharger internal combustion engine in accordance with an alternative embodiment of the present invention.

FIG. 5 illustrates a closed crankcase ventilation system for a turbocharger and throttled engine using a high restriction filter. As with the above-described closed crankcase ventilation system, the system illustrated in FIG. 5 is combined with an internal combustion engine and preferably a natural gas driven internal combustion engine 200. This engine is of the conventional type and includes cylinder head 202, a crankcase portion 204 and oil sump 206. A coalescing filter 208 or other suitable high restriction separator communicates with the crankcase 204 of the internal combustion engine 200 by way of passage 210. Many systems which utilize the coalescing filter 208 are disadvantaged by the high pressure drop which occurs across such a filter, irrespective of flow, however, such filter has been proven to exhibit the greatest oil separation efficiency. Accordingly, it is the primary object of the present invention to provide systems wherein such a coalescing filter can be used while minimizing the drawbacks of the high pressure drop across the filter. The passage 210 is connected to the filter head 212 which is also connected to passage 214 emanating from the filter head 212. In a known manner, the coalescing filter 208 passes oil separated from the crankcase gases by way of passage 216 with the flow of oil back to the sump 206 through passage 216 being controlled by the check valve 218. Also emanating from the filter head 212 is bypass passage 220, the significance of which will be explained in greater detail hereinbelow.

Within the filter head 212 is a crankcase vacuum control valve and filter bypass for bypassing the coalescing filter 208 during low vacuum conditions. The control valve 222 controls the flow of crankcase gases to either the bypass passage 220 during low vacuum conditions or through the coalescing filter 208 during high vacuum conditions. The control valve may be readily controlled in a known manner by controls from an electronic control unit which receives signals from various points along the flow path to determine the vacuum conditions. The passage 214 is connected in one manner by way of passage 224 to an intake manifold 226. The passage 224 includes check valve 228 for permitting one-way passage of flow through a passage 224. Similar to the previous embodiment, the coalescing filter 208 is also connected by way of passages 214 and 230 to the low pressure side 232 of a turbocharger 234. This connection being made in the manner discussed hereinabove with respect to FIGS. 1, 2 and 3. As is well known, the turbocharger draws air through air filter 236 and into the turbocharger wherein the air is compressed and passed to an aftercooler 238 by way of passage 240. As with the previous embodiment, the connection 232 draws a vacuum through passage 230 and 214 and is utilized during high vacuum flow conditions. As with the passage 224, the passage 230 includes a one-way check valve 242 for permitting flow in a direction from the coalescing filter 208 towards the turbocharger 234. It is noted that the check valves 228 and 242 are illustrated in a simple form, however, such valves may take on any configuration in order to accomplish the objectives of the overall system. Additionally, a throttle 244 is provided between the aftercooler 238 and the intake manifold 226 in a known manner.

Figure 6:
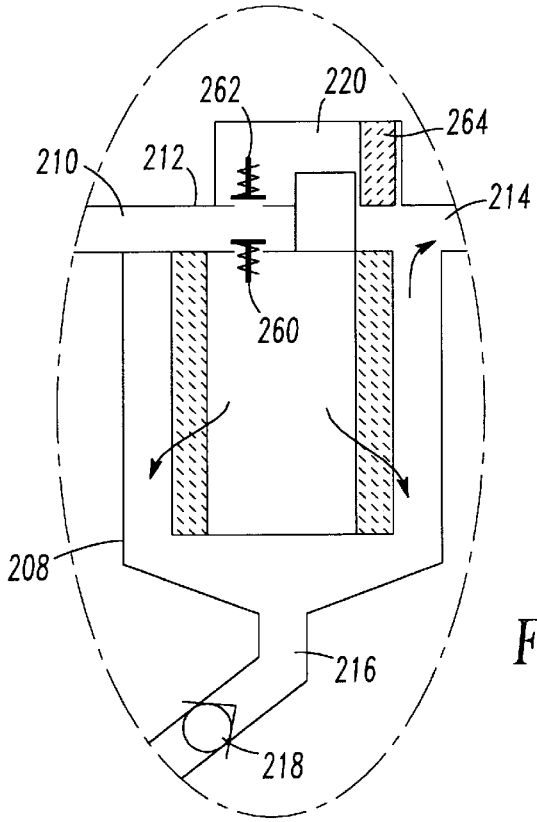
FIG. 6 is an expanded view of the encircled area A of FIG. 5.

With reference to FIG. 6, the coalescing filter 208 and bypass arrangement are illustrated in greater detail. As discussed hereinabove, the passage 210 is connected to filter head 212 such that the crankcase gases flow either through the coalescing filter 208 or bypass passage 220 and exit the filter by way of passage 214. Positioned within the head 212 is a vacuum limiting valve 260 which when displaced, permits the crankcase gases to pass into the filter 208 through the filtering material where oil is separated from the crankcase gases and exits by way of passage 214. When the coalescing filter 208 becomes clogged, the vacuum limiting valve 260 will close thus opening the bypass valve 262 thereby directing the crankcase gases through the bypass passage 220 and ultimately out through the passage 214. Additionally, positioned within the bypass flow passage 220 is a coarse bypass filter 264 which filters the crankcase gases to some extent. Once the crankcase gases leave the coalescing filter assembly by way of passage 214, the crankcase gases are directed to either the turbocharger 234 or intake manifold 226 depending upon the particular operating conditions of the engine.

Operation of the above-described system will now be set forth in greater detail.

Again, with reference to FIG. 5, when the engine is throttled which is typical of natural gas engines, at high loads, there is sufficient turbo vacuum to draw crankcase gases by way of passage 210 through the coalescing filter 208 by way of the connection 232. Additionally, a positive boost pressure of the intake manifold also occurs, thus the check valve 228 will be closed while the check valve 242 will be open, thereby directing the flow to the turbocharger 234. Under these conditions, the bypass valve 222 directs the flow through the coalescing filter 208, such that oil separating will occur. At light loads or during idle, there is a high vacuum in the intake manifold, however, the vacuum at the low pressure side of the turbocharger is low. Consequently, check valve 242 will close while check valve 228 will open thereby directing gas flow to the intake manifold. Under such conditions, the bypass valve 222 continues to direct crankcase gas through the coalescing filter 208.

However, under medium load conditions, when the intake manifold has a positive pressure, thus closing the check valve 228, but the turbocharger does not produce a strong enough vacuum to draw the crankcase gases through the coalescing filter 208, the bypass valve 222 is controlled so as to direct the crankcase gases through bypass passage 220 and onward to the turbocharger 234 by way of passage 230 through check valve 242. Consequently, it is only during medium load conditions wherein the intake manifold pressure is high and the vacuum drawn by the turbocharger 234 is insufficient to draw the crankcase gases through the coalescing filter 208 that the coalescing filter 208 is not in use. The particular details of the coalescing filter and bypass passage are shown with reference to FIG. 6. Otherwise, during high load conditions, low load conditions or idle conditions, the crankcase gases are drawn through the coalescing filter 208 by way of the high vacuum experienced in the intake manifold 226 (during light load or idle conditions) or by the sufficient turbo vacuum generated on the low side of the turbocharger 234 (during high load conditions). In simple terms, the crankcase gases are directed to the source of greatest vacuum. Accordingly, a practical and economical ventilation system is capable of separating substantially all of the oil droplets entrained and the gas is expelled from the engine crankcase is achieved. Further, such a crankcase ventilation system can be readily adapted to a variety of turbocharger internal combustion engines.

While the present invention is being described with reference to a preferred embodiment as well as alternative embodiments, it will be appreciated by those skilled in the art that the invention may be practiced otherwise then as specifically described herein without departing from the spirit and scope of the invention. It is, therefore, to be understood that the spirit and scope of the invention be limited only by the appended claims.

INDUSTRIAL APPLICABILITY

The crankcase ventilation system of the present invention with its high vacuum potential and coalescing filter will find its primary application in a turbocharger internal combustion engine where an effective filtration of blow-by gas is required.

What is claimed is:

1. A crankcase ventilation system for a turbocharger internal combustion engine, said system comprising:

a crankcase, and a compressor inlet covered by a shroud;

a main flow line communicating between said crankcase and said compressor inlet shroud, said main flow line communicating with the innermost diameter of said shroud covering said compressor inlet;

a vacuum limiting means positioned in said main flow line for limiting the maximum vacuum in said crankcase;

a bypass means in said main flow line for directing air flow through said system;

an air contaminant mixtures separation means positioned in said main flow line for separating air contaminant mixtures, said separation means including at least one high restriction separator; and a secondary flow line communicating between said bypass means to a point of said main flow line downstream of said air contaminant mixture separation means.

2. The crankcase ventilation system for a turbocharger internal combustion engine of claim 1, wherein said main flow line communicates with said inlet shroud at a zone where a predetermined vacuum level can be drawn from said compressor inlet.

3. The crankcase ventilation system for a turbocharger internal combustion engine of claim 2, wherein a zone of reduced pressure is located along said innermost diameter of said compressor inlet shroud.

4. The crankcase ventilation system for a turbocharger internal combustion engine of claim 3, wherein a fitting connects said flow line to said zone of reduced pressure at said compressor inlet shroud.

5. The crankcase ventilation system for a turbocharger internal combustion engine of claim 4, wherein said fitting is threaded into support webs connecting the innermost diameter of said compressor inlet shroud with the outside diameter of the compressor inlet.

6. The crankcase ventilation system for a turbocharger internal combustion engine of claim 2, wherein said vacuum limiting means limits the maximum vacuum maintained in a crankcase to approximately 2 inches of water.

7. The crankcase ventilation system for a turbocharger internal combustion engine of claim 6, wherein said bypass means will direct blow-by gas through a secondary filter positioned in said secondary flow line when a vacuum in said compressor inlet is less than that required to drive said high restriction separator and said bypass means will direct blow-by gas to said air contaminant mixture separation means when the vacuum in said compressor inlet is greater than that required to drive said high restriction separator.

8. The crankcase ventilation system for a turbocharger internal combustion engine of claim 7, wherein said secondary filter comprises a low restriction filter medium.

9. The crankcase ventilation system for a turbocharger internal combustion engine of claim 8, wherein said low restriction filter medium includes at least one of a wire mesh, steel wool, plastic foam and fiberglass.

10. The crankcase ventilation system for a turbocharger internal combustion engine of claim 1, wherein said system further comprises a drain means in communication with said air contaminant mixtures separation means for draining said air contaminant mixtures.

11. The crankcase ventilation system for a turbocharger internal combustion engine of claim 10, wherein said drain means includes a drain having a check valve positioned therein such that contaminant mixtures only flow one-way in a direction away from said air contaminant mixtures separation means through said drain means.

12. In a turbocharger internal combustion engine, a system for ventilating crankcase gases from a crankcase of the engine comprising:

a flow passage communicating between the crankcase and a turbocharger of the engine, said flow passage communicates with the innermost diameter of said shroud covering said turbocharger inlet;

an air flow driven air contaminant mixture separation means positioned in said flow passage for separating air contaminant mixtures from crankcase gases;

a first connection means for connecting a first end of said flow passage to the crankcase; and a second connection means for connecting a second end of said flow passage to a predetermined point at the turbocharger;

wherein said predetermined point of the turbocharger is a point where a vacuum sufficient to drive said air flow driven air contaminant mixtures separation means.

13. The crankcase ventilation system for a turbocharger internal combustion engine of claim 12, wherein said flow passage communicates with said inlet shroud at a zone where a predetermined vacuum level can be drawn from said compressor inlet.

14. The crankcase ventilation system for a turbocharger internal combustion engine of claim 13, wherein a zone of reduced pressure is located along said innermost diameter of said compressor inlet shroud.

15. The crankcase ventilation system for a turbocharger internal combustion engine of claim 14, wherein a bypass means is positioned along said flow passage.

16. The crankcase ventilation system for a turbocharger internal combustion engine of claim 15, wherein said separation means is a high restriction separator.

17. The crankcase ventilation system for a turbocharger internal combustion engine of claim 16, wherein said bypass means will direct blow-by gas to a secondary filter by way of a secondary flow line when a vacuum in said compressor inlet is less than that required to drive said high restriction separator and said bypass means will direct blow-by gas to said air contaminant mixture separation means when the vacuum in said compressor inlet is greater than that required to drive said high restriction separator.

18. The crankcase ventilation system for a turbocharger internal combustion engine of claim 17, wherein said secondary filter comprises a low restriction medium.

19. The crankcase ventilation system for a turbocharger internal combustion of engine of claim 18, wherein said low restriction medium includes at least one of a wire mesh, steel wool, plastic foam and fiberglass.

20. The crankcase ventilation system for a turbocharger internal combustion engine of claim 12, wherein said system further comprises a drain means in communication with said air contaminant mixtures separation means for draining said air contaminant mixtures.

21. The crankcase ventilation system for a turbocharger internal combustion engine of claim 20, wherein said drain means includes a drain having a check valve positioned therein such that contaminant mixtures only flow one-way in a direction away from said air contaminant mixtures separation means through said drain means.

* * * * *